United States Patent [19]

Siemek

[11] Patent Number: 4,511,039

[45] Date of Patent: Apr. 16, 1985

[54] HAMBURGER HOLDER

[76] Inventor: Stanislaw Siemek, 58 Elsfield Rd., Toronto, Ontario, Canada

[21] Appl. No.: 534,882

[22] Filed: Sep. 22, 1983

[51] Int. Cl.[3] ..... B65D 5/36; B65D 85/00

[52] U.S. Cl. ..... 206/525; 229/30; 229/16 R; 229/DIG. 13; 229/8; 426/115

[58] Field of Search ..... 206/525, 494, 39; 229/8, 32, 30, DIG. 14; 426/115

[56] References Cited

U.S. PATENT DOCUMENTS

| | | | |
|---|---|---|---|
| 624,719 | 4/1927 | Dixon | 206/39 |
| 3,126,145 | 3/1964 | Struble | 229/8 |
| 3,294,229 | 12/1966 | McConnell et al. | 206/494 |
| 3,355,082 | 11/1967 | Wood | 426/115 |
| 3,391,782 | 7/1968 | Kaspar | 206/525 |
| 3,446,416 | 5/1969 | Epstein | 229/31 R |
| 3,610,512 | 10/1971 | Hermalin | 229/32 |

*Primary Examiner*—William T. Dixson, Jr.
*Attorney, Agent, or Firm*—Rogers, Bereskin & Parr

[57] ABSTRACT

A device for holding a hamburger during its consumption is described. The holder includes a thin hourglass-shaped body member formed at either of its enlarged ends with a U-shaped jaw. The body member is formed of a semi-rigid plastic which flexes about its narrow central portion or is formed with a fold line that serves as a hinge, whereby the jaws can be drawn towards one another. A user can grip a hamburger between the jaws thereby avoiding excessive finger contact with the foodstuff during consumption.

4 Claims, 3 Drawing Figures

HAMBURGER HOLDER

FIELD OF THE INVENTION

The invention relates generally to the field of eating utensils, and more specifically to a device for use in holding a hamburger during its consumption.

BACKGROUND OF THE INVENTION

Hamburgers are commonly held in the fingers of the hand and consequently there is a tendancy for the contents of the hamburger, particularly condiments such as mustard or relish, to contact the hands. Knapkins or the paper in which hamburgers are commonly wrapped are not satisfactory holding means. Condiments tend to soak through or a hamburger cannot be conveniently handled when only a small portion remains. It is consequently an object of the present invention to provide a device with which a hamburger can be conveniently held during consumption.

BRIEF SUMMARY OF THE INVENTION

The invention provides a hamburger holder having a body member formed of a semi-rigid material such as thin plastic or cardboard. The body member has central portion, a first end portion formed with a generally U-shaped open jaw, and a second end portion formed with a second generally U-shaped open jaw. The term "open" as used in this disclosure and in the appended claims with respect to a U-shaped jaw means that the U-shaped structure has an open end exposed for receipt of a foodstuff.

The body member is adapted (for example, by ensuring that the semi-rigid material of the body member has sufficient flexibility to permit flexing of the central portion or by providing the central portion with a hinge line) to permit pivotting of the first jaw about the central portion towards the second jaw. The jaws pivot between an open position in which a hamburger can be received and a second position in which the jaws are oriented in aligned opposing relationship with the first jaw contacting one of the top and bottom of the hamburger and the second jaw contacting the other of the top and bottom of the hamburger, both jaws overlaying the side of the hamburger to ensure that the hamburger does not slip sideways from the jaws if the user's grip on the jaws is released to withdraw the hamburger further from the jaws. The term "aligned opposing relationship" as used in this disclosure and the appended claims with respect to a pair of U-shaped jaws is intended to indicate that the U-shaped structures open towards one another and have open ends facing in the same general direction and so oriented that a foodstuff such as a hamburger can be located in the open ends between the jaws.

BRIEF DESCRIPTION OF THE DRAWINGS

The invention will be better understood with reference to drawings in which.

DESCRIPTION OF PREFERRED EMBODIMENT

Figure 1:
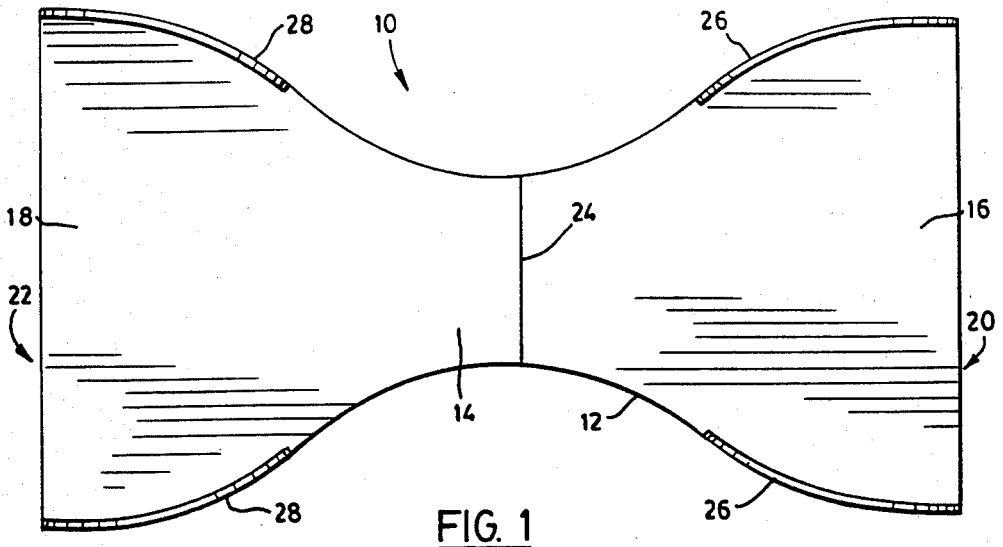
FIG. 1 is a plan view of a preferred embodiment of a hamburger holder.
Figure 2:
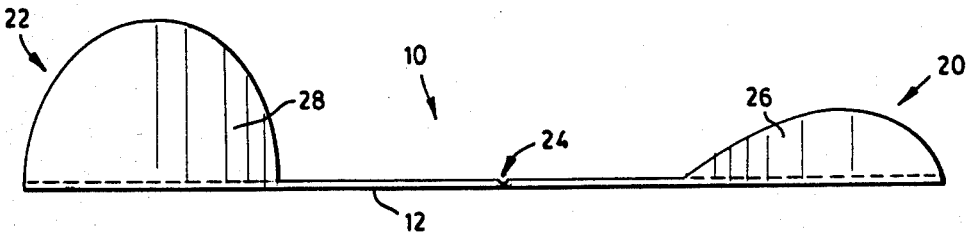
FIG. 2 is a side elevational view of the hamburger holder.
Figure 3:
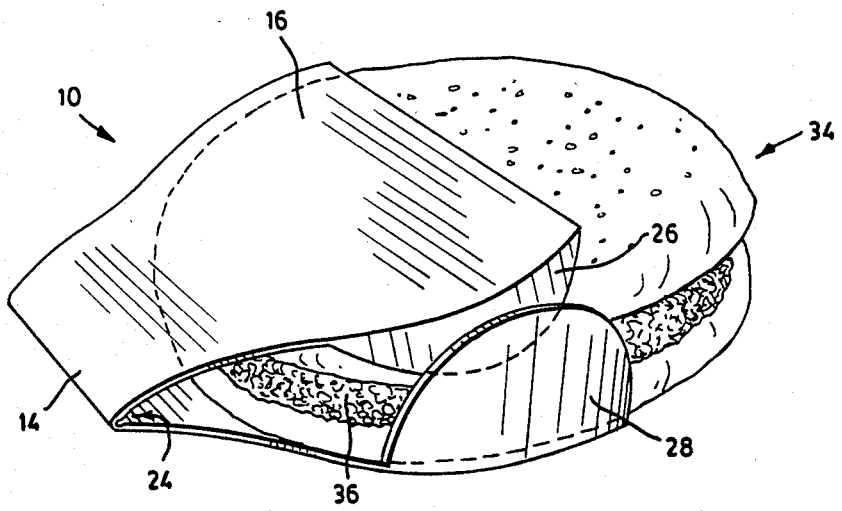
FIG. 3 is a perspective view illustrating the hamburger holder located about a hamburger.

FIGS. 1–3 illustrate a preferred embodiment 10 of a hamburger holder integrally molded of a plastic. The holder 10 has an hourglass-shaped body member 12 with a narrow central portion 14, a first end portion 16 and a second end portion 18. The first end portion 16 is formed with a pair of spaced-apart retaining flanges which extend transversely form the first end portion 16 to define therewith a first generally U-shaped open jaw 20. The second end portion 18 is formed with a second pair of spaced-apart retaining flanges which extend transversely from the second end portion 18 and define therewith a second generally U-shaped open jaw 22.

The central portion 14 is formed with a hinge line 24. The hinge line is a constriction in the plastic of the body member 12 which permits the first jaw 20 to be pivotted towards the second jaw 22, about the central portion 14. Alternatively, the plastic material of the body member 12 can be selected to have sufficient inherent flexibility so that the central portion 14 can without the hinge line 24 serve as hinge means permitting the required pivotting of the jaws 20,22.

The hourglass shape of the body member 12 has several advantages. First, the resultant shape of the hamburger holder 10 is ideally suited for holding in the hand. Second, the attendant narrowness of the central portion 14 enhances the flexibility of the central portion thereby facilitating pivotting of the jaws 20,22. The latter feature can be significant for example where the holder is to be constructed of a thin cardboard rather than a plastic which can be conveniently molded with a hinge.

The relative dimensioning of the flanges is significant. The flanges 26 of the first end portion 16 are shorter and more closely spaced than are the flanges 28 of the second end portion 18. When pivotted from an open position (such as the relative position illustrated in FIGS. 1 and 2 in which a hamburger can be conveniently received on one of the jaws 20,22), the flanges 26 eventually locate between the flanges 28. The shallower depth of the first jaw 20 then ensures that the jaws 20,22 can be advanced sufficiently towards one another that a closed position can be reached, as in FIG. 3, in which the top 30 and bottom 32 of a hamburger 34 are firmly gripped.

In FIG. 3, the jaws 20, 22 are oriented in aligned opposing relationship with the flanges 26,28 overlaying the side 36 of the hamburger 34. The flanges 26,28 thus ensure that the hamburger 34 does not slip from the holder 10 when for example a user releases his grip on the holder 10 to advance the hamburger outwardly from the jaws 20,22.

It will be appreciated that a preferred embodiment of the invention has been described and that modifications may be made therein without departing from the spirit of the invention or the scope of the appended claims.

I claim:

1. A hamburger holder comprising a body member formed of a semi-rigid material, the body member having a central portion, a first end portion formed with a first generally U-shaped open jaw, and a second end portion formed with a second generally U-shaped open jaw, the first jaw being narrower and shallower than the second jaw to enable the first jaw to enter the second jaw, and the body member being adapted to permit pivoting of the first jaw about the central portion towards the second jaw between an open position in which a hamburger can be received in the jaws and a closed position in which the jaws are orientated substantially in aligned opposing relationship with the first jaw contacting one of the top and the bottom of the hamburger and overlaying the side of the hamburger and with the second jaw contacting the other of the top and bottom of the hamburger and overlaying the side of the hamburger.

2. A hamburger holder as claimed in claim 1 in which the material of the body member is sufficiently flexible to permit the pivotting of the first jaw towards the second jaw.

3. A hamburger holder as claimed in claim 1 in which the central portion is formed with hinge means which permit pivotting of the first jaw towards the second jaw.

4. A hamburger holder as claimed in claim 1 in which the body member has substantially an hourglass shape, the first and second end portions being larger than the central portion.

* * * * *